US009564710B2

(12) United States Patent
Ebihara

(10) Patent No.: US 9,564,710 B2
(45) Date of Patent: Feb. 7, 2017

(54) LEVER CONNECTOR ASSEMBLY

(71) Applicant: Japan Aviation Electronics Industry, Ltd., Tokyo (JP)

(72) Inventor: Hiroyuki Ebihara, Tokyo (JP)

(73) Assignee: JAPAN AVIATION ELECTRONICS INDUSTRY, LTD., Tokyo (JP)

( * ) Notice: Subject to any disclaimer, the term of this patent is extended or adjusted under 35 U.S.C. 154(b) by 0 days.

(21) Appl. No.: 14/856,817

(22) Filed: Sep. 17, 2015

(65) Prior Publication Data

US 2016/0126671 A1 May 5, 2016

(30) Foreign Application Priority Data

Oct. 29, 2014 (JP) ..... 2014-220271

(51) Int. Cl.
*H01R 13/629* (2006.01)
*H01R 107/00* (2006.01)

(52) U.S. Cl.
CPC .. *H01R 13/62933* (2013.01); *H01R 13/62938* (2013.01); *H01R 13/62944* (2013.01); *H01R 13/62955* (2013.01); *H01R 2107/00* (2013.01)

(58) Field of Classification Search
CPC ..... H01R 13/62933; H01R 13/62944; H01R 13/62938; H01R 13/62955; H01R 2107/00
USPC ..... 439/157, 153, 372, 660, 345
See application file for complete search history.

(56) References Cited

U.S. PATENT DOCUMENTS 5,174,785 A 12/1992 Endo et al.
5,322,448 A * 6/1994 Hahn ..... H01R 13/62944 439/153
5,603,624 A 2/1997 Taguchi et al.
6,183,275 B1 * 2/2001 Okura ..... H01R 13/62933 439/157
6,764,324 B2 * 7/2004 Shinozaki ..... H01R 13/62933 439/157

(Continued)

FOREIGN PATENT DOCUMENTS

GB 2179506 A 3/1987
GB 2289171 A 11/1995

(Continued)

OTHER PUBLICATIONS

Extended European Search Report dated Jan. 19, 2016, in connection with corresponding EP Application No. 15187147.2 (9 pgs.).

*Primary Examiner* — Abdullah Riyami
*Assistant Examiner* — Harshad Patel
(74) *Attorney, Agent, or Firm* — Maier & Maier, PLLC

(57) ABSTRACT

A technique to reduce workload on an operator during mating of a lever connector is provided. A plug and a receptacle are pulled together by rotation of a lever in a locking direction. The lever has a pinion first driven surface facing in an unlocking direction. A receptacle housing has a rack first driving surface facing in a separating direction. In a state where the plug confronts the receptacle so as to mate the plug with the receptacle, a clearance between the pinion first driven surface and the rack first driving surface is smaller than a clearance between a contact piece and a pin portion. When the plug is moved toward the receptacle, the pinion first driven surface first comes into contact with the rack first driving surface and the lever rotates in the locking direction, and then the contact piece comes into contact with the pin portion.

3 Claims, 25 Drawing Sheets

(56) References Cited

U.S. PATENT DOCUMENTS

| | | | | |
|---|---|---|---|---|
| 6,997,725 | B2 * | 2/2006 | Stella | H01R 13/453 439/157 |
| 7,104,819 | B2 * | 9/2006 | Yamaoka | H01R 13/62944 439/153 |
| 7,134,901 | B2 * | 11/2006 | Okura | H01R 13/4538 439/372 |
| 7,261,575 | B2 * | 8/2007 | Buchter | H01R 13/62944 439/157 |
| 7,407,396 | B2 * | 8/2008 | Dillon | H01R 13/62933 439/157 |
| 7,445,491 | B2 * | 11/2008 | Fujii | H01R 13/62938 439/157 |
| 7,597,569 | B2 * | 10/2009 | Okuda | H01R 13/62955 439/157 |
| 7,641,486 | B2 * | 1/2010 | Tonosaki | H01R 13/62938 439/157 |
| 8,986,024 | B2 * | 3/2015 | Ikeda | H01R 13/62955 439/157 |
| 9,124,033 | B2 * | 9/2015 | Hirano | H01R 13/62955 |
| 2003/0109166 | A1 * | 6/2003 | Ookura | H01R 13/5202 439/372 |
| 2008/0090435 | A1 * | 4/2008 | Ikeya | H01R 13/62938 439/157 |
| 2009/0305536 | A1 * | 12/2009 | Martin | H01R 13/62955 439/157 |
| 2011/0124123 | A1 * | 5/2011 | Sugiyama | G01N 33/57426 436/501 |
| 2011/0143571 | A1 * | 6/2011 | Fukamachi | H01R 13/62938 439/345 |
| 2011/0250771 | A1 * | 10/2011 | Suzuki | H01R 13/62933 439/157 |
| 2012/0302086 | A1 * | 11/2012 | Oiri | H01R 13/62944 439/372 |

FOREIGN PATENT DOCUMENTS

| | | | |
|---|---|---|---|
| JP | 2013-004419 | A | 1/2013 |
| WO | 2006/020924 | A2 | 2/2006 |

* cited by examiner

RELATED ART

LEVER CONNECTOR ASSEMBLY

INCORPORATION BY REFERENCE

This application is based upon and claims the benefit of priority from Japanese patent application No. 2014-220271, filed on Oct. 29, 2014, the disclosure of which is incorporated herein in its entirety by reference.

BACKGROUND OF THE INVENTION

1. Field of the Invention

The present invention relates to a lever connector.

2. Description of Related Art

As shown in FIG. 25 of this application, Japanese Unexamined Patent Application Publication No. 2013-4419 discloses a lever connector 100 which includes a rack-and-pinion mechanism. In the lever connector 100, shallowly mating a housing 102 with a mating housing 101 enables rack teeth 106 of a rack portion 105 to mesh with pinion teeth 104 of a pinion portion 103.

When a lever 107 is rotated with a finger placed on an operation portion 108 of the lever 107, the rack-and-pinion mechanism works. As a result, the mating housing 101 is pulled toward the housing 102 with a small operating force.

When the lever 107 is rotated to a predetermined position, a cover 109 also moves to a closed position in accordance with the rotation of the lever 107, so that a lock portion 112 is mated with a lock hole 111 of a lock piece 110. Accordingly, the cover 109 is held at the closed position and the lever 107 is also held at the mating position.

How much it is necessary to operate the lever 107 is determined by various design parameters, such as a movement necessary for the housing 102 with respect to the mating housing 101 when the housing 102 is pulled toward the mating housing 101, and the magnitude of the boosting effect of the rack-and-pinion mechanism required when the housing 102 is pulled toward the mating housing 101.

However, emphasis has not been placed on reducing a workload on an operator by reducing how much the lever 107 is operated.

It is an object of the present invention to provide a technique that reduces a workload on an operator during mating of a lever connector.

SUMMARY OF THE INVENTION

An exemplary aspect of the present invention is a lever connector including: a plug including: a plug contact including a plug contact portion; a plug housing that holds the plug contact; and a lever that is rotatably attached to the plug housing; and a receptacle including: a receptacle contact including a receptacle contact portion capable of coming into contact with the plug contact portion; and a receptacle housing that holds the receptacle contact, the plug and the receptacle being pulled together by rotation of the lever in a first rotation direction. The lever has a lever driven surface that faces in a second rotation direction, the second rotation direction being opposite to the first rotation direction. The receptacle housing has a receptacle driving surface that faces in a separating direction, the separating direction being opposite to an approaching direction in which the plug is caused to approach the receptacle so as to mate the plug with the receptacle. In a state where the plug confronts the receptacle so as to mate the plug with the receptacle, a distance between the lever driven surface and the receptacle driving surface is smaller than a distance between the plug contact portion and the receptacle contact portion. When the plug is moved toward the receptacle, the lever driven surface is first brought into contact with the receptacle driving surface, and then the lever rotates in the first rotation direction, and after that, the plug contact portion is brought into contact with the receptacle contact portion.

According to the present invention, it is possible to reduce a workload on an operator during mating of a lever connector.

The above and other objects, features and advantages of the present invention will become more fully understood from the detailed description given hereinbelow and the accompanying drawings which are given by way of illustration only, and thus are not to be considered as limiting the present invention.

DESCRIPTION OF THE EXEMPLARY EMBODIMENTS

Figure 1:
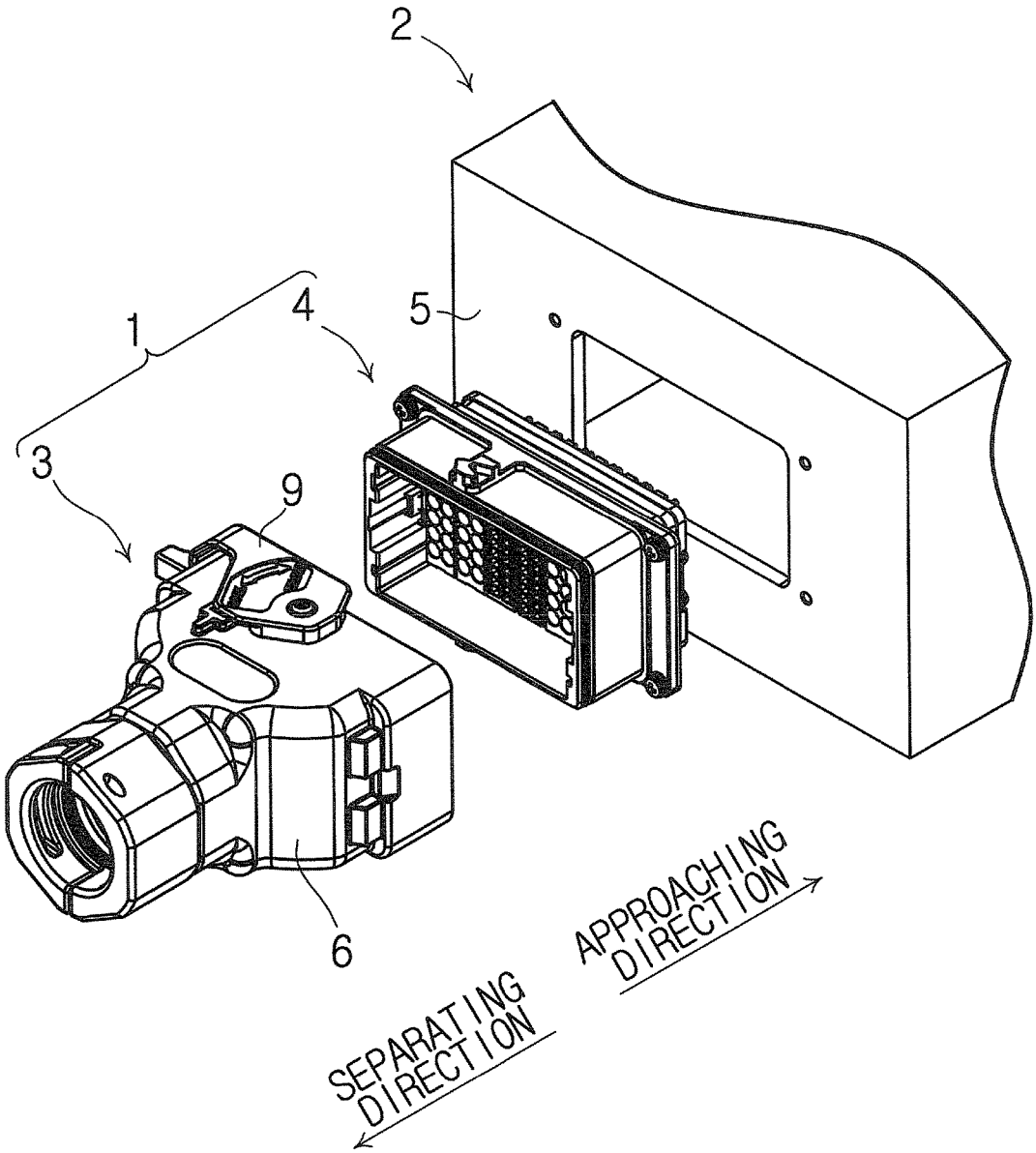
FIG. 1 is a perspective view showing a state before mating of a lever connector.

A lever connector 1 will be described below with reference to FIGS. 1 to 24. FIG. 1 shows a state before mating of the lever connector 1. As shown in FIG. 1, the lever connector 1 according to an exemplary embodiment is used as, for example, an interface of an airtight casing 2, such as industrial equipment. The lever connector 1 includes a plug 3 (first connector member) and a receptacle 4 (second connector member).

The casing 2 includes a front panel 5. The thickness direction of the front panel 5 is horizontal in this exemplary embodiment.

Figure 2:
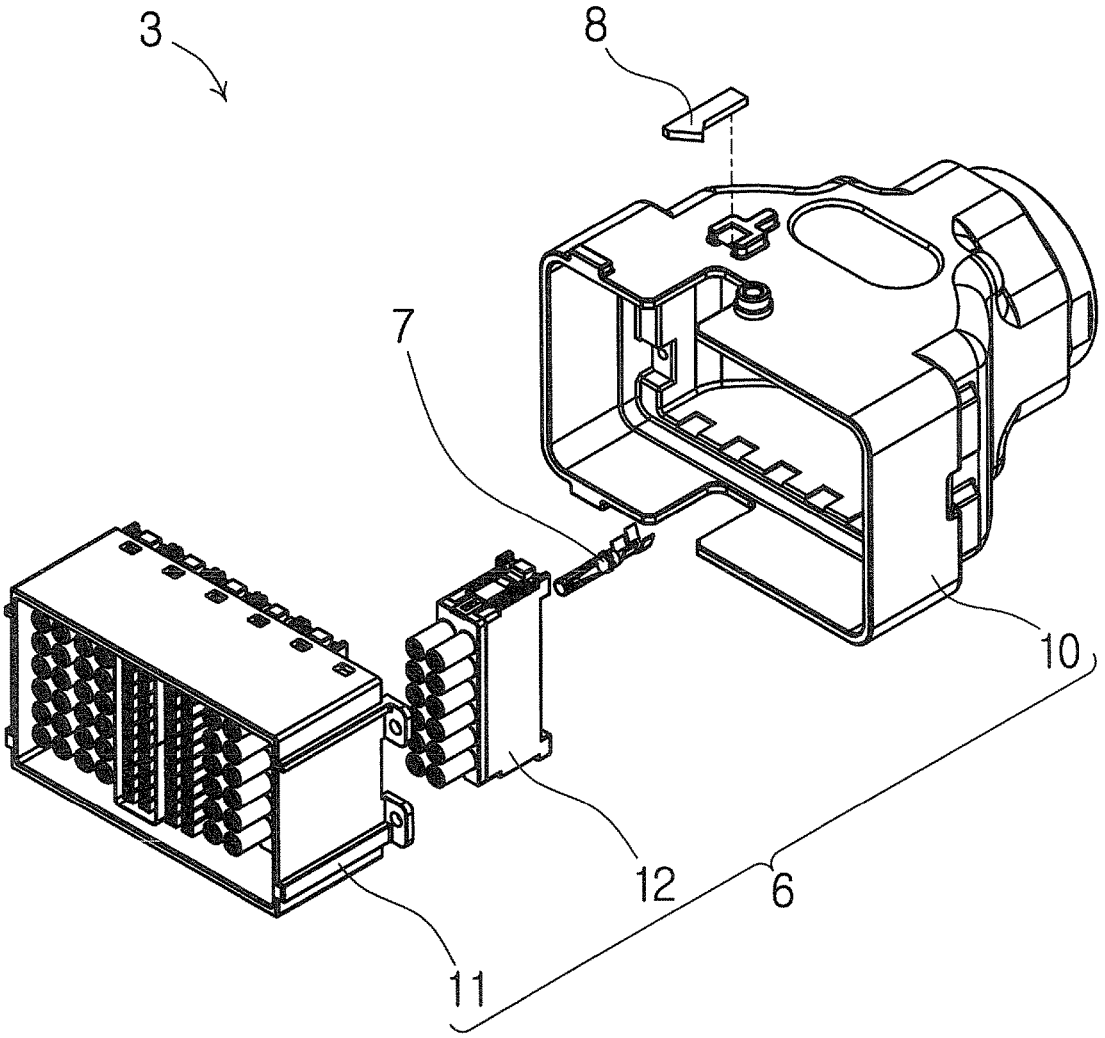
FIG. 2 is an exploded perspective view of a plug.

The plug 3 is a connector member which is attached to an end of an electric wire bundle that is a bundle of a plurality of electric wires used for power supply and signal communication. FIG. 2 is an exploded view of the plug 3. As shown in FIGS. 1 and 2, the plug 3 includes a plug housing 6, a plurality of plug contacts 7, a temporary holding spring 8 (a temporary holding elastic piece, a temporary holding mechanism), and a lever 9. As shown in FIG. 2, the plug housing 6 includes a plug hood 10 made of an aluminum alloy, a plug barrel 11 made of an insulating resin, and a plurality of plug insulators 12 made of an insulating resin. Each of the plug insulators 12 holds the plurality of plug contacts 7. The plug barrel 11 holds the plurality of plug insulators 12. The plug barrel 11 is accommodated in the plug hood 10. The temporary holding spring 8 is an elastic piece and is attached to the plug hood 10 in a cantilever manner. As shown in FIG. 1, the lever 9 is rotatably attached to the plug housing 6.

Figure 3:
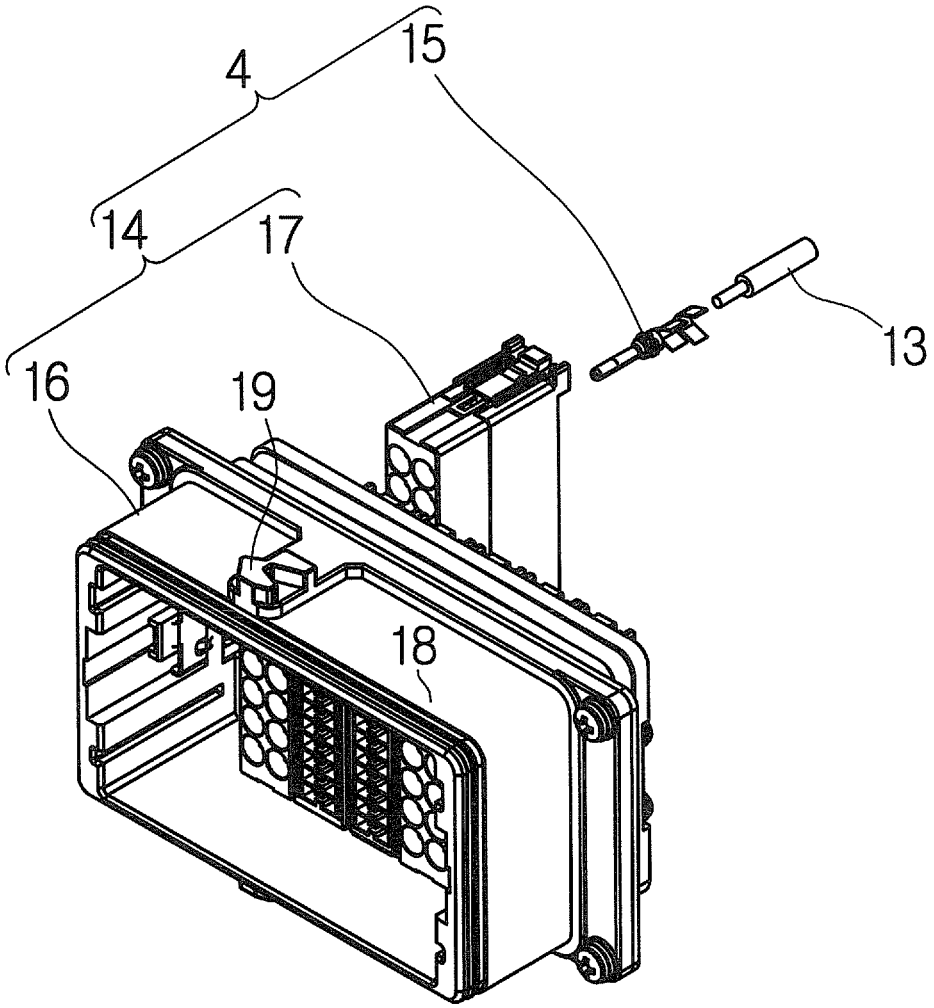
FIG. 3 is an exploded perspective view of a receptacle.

FIG. 3 is an exploded view of the receptacle 4. As shown in FIGS. 1 and 3, the receptacle 4 is a connector member that is attached to the front panel 5 of the casing 2 and allows electric wires 13 within the casing 2 to be attached to the receptacle 4. As shown in FIG. 3, the receptacle 4 includes a receptacle housing 14 and a plurality of receptacle contacts 15. The receptacle housing 14 includes a receptacle shell 16 made of an aluminum alloy, and a plurality of receptacle insulators 17 made of an insulating resin. Each of the receptacle contacts 15 is attached to an end of the corresponding electric wire 13. Each of the receptacle insulators 17 holds the plurality of receptacle contacts 15. The receptacle shell 16 holds the plurality of receptacle insulators 17. The receptacle shell 16 is formed into a rectangular tubular shape. Racks 19 are formed on an outer surface 18 of the receptacle shell 16.

Figure 4:
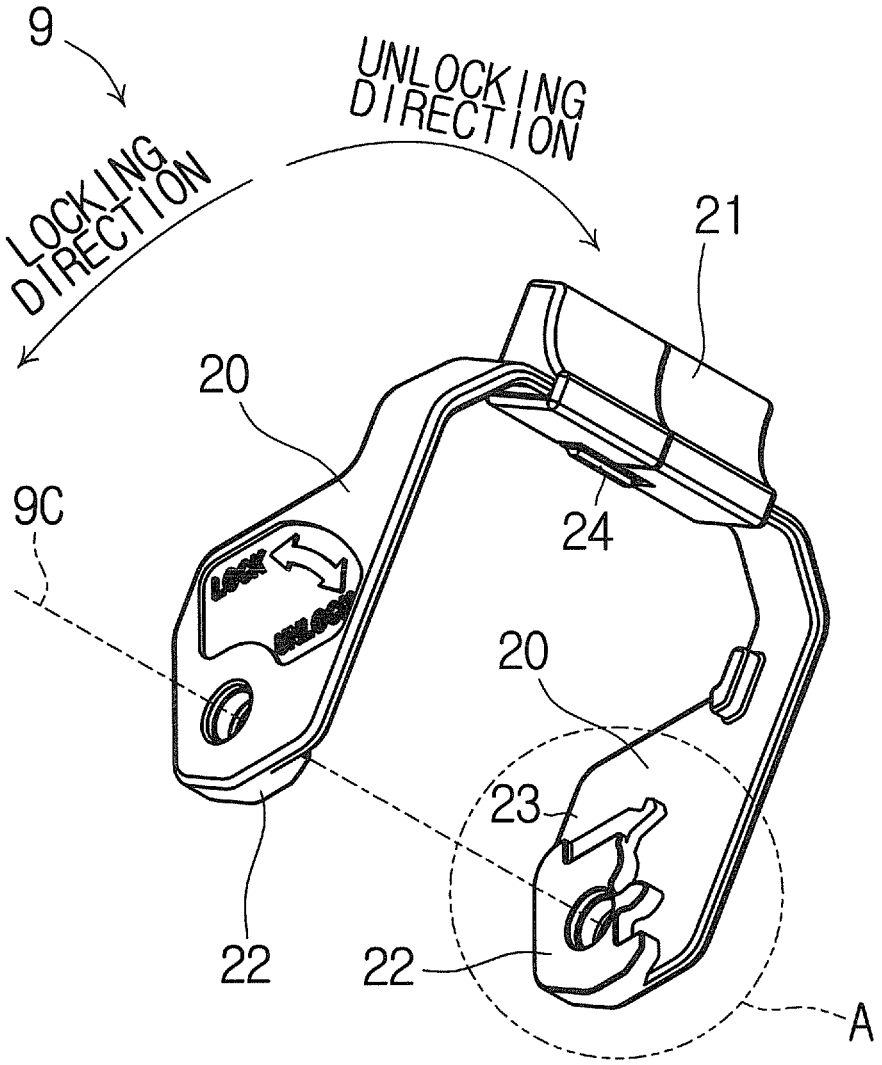
FIG. 4 is a perspective view of a lever.

As shown in FIG. 1, the lever 9 is rotatably attached to the plug housing 6. FIG. 4 shows the lever 9 and a lever rotation axis 9C which is a rotation axis of the lever 9. As shown in FIG. 4, the lever 9 includes two lever opposed portions 20, a lever operating portion 21, and two pinions 22. The lever opposed portions 20 are plate bodies which are opposed to each other in the axial direction of the lever rotation axis 9C. The thickness direction of each lever opposed portion 20 coincides with the axial direction of the lever rotation axis 9C. Each of the pinions 22 is formed on an inner surface 23 of the corresponding lever opposed portion 20 in such a manner that the pinion 22 projects inward. The lever operating portion 21 is a portion that couples the two lever opposed portions 20. The lever operating portion 21 has a lever lock spring 24 formed thereon. The lever lock spring 24 is an elastic piece that is supported by the lever operating portion 21 in a cantilever manner.

In the structure described above, when the plug 3 shown in FIG. 1 is inserted into the receptacle 4 and the lever 9 shown in FIG. 4 is rotated in a locking direction (first rotation direction), the racks 19 shown in FIG. 3 and the pinions 22 shown in FIG. 4 collaborate with each other as a so-called rack-and-pinion mechanism, with the result that a strong mating force is generated. Accordingly, the plug 3 and the receptacle 4 are pulled together and then mated together.

The terms "locking direction", "unlocking direction (second rotation direction)", "approaching direction", and "separating direction" will now be defined. As shown in FIG. 4, the locking direction is a direction in which the lever 9 is rotated so that the plug 3 and the receptacle 4 are pulled together. The unlocking direction is a direction opposite to the locking direction. As shown in FIG. 1, the approaching direction is a direction in which the plug 3 is caused to approach the receptacle 4 in a state where the plug 3 confronts the receptacle 4 so as to mate the plug 3 with the receptacle 4. The separating direction is a direction in which the plug 3 is separated from the receptacle 4 in the state shown in FIG. 1. That is, the approaching direction and the separating direction are opposite directions.

Figure 5:
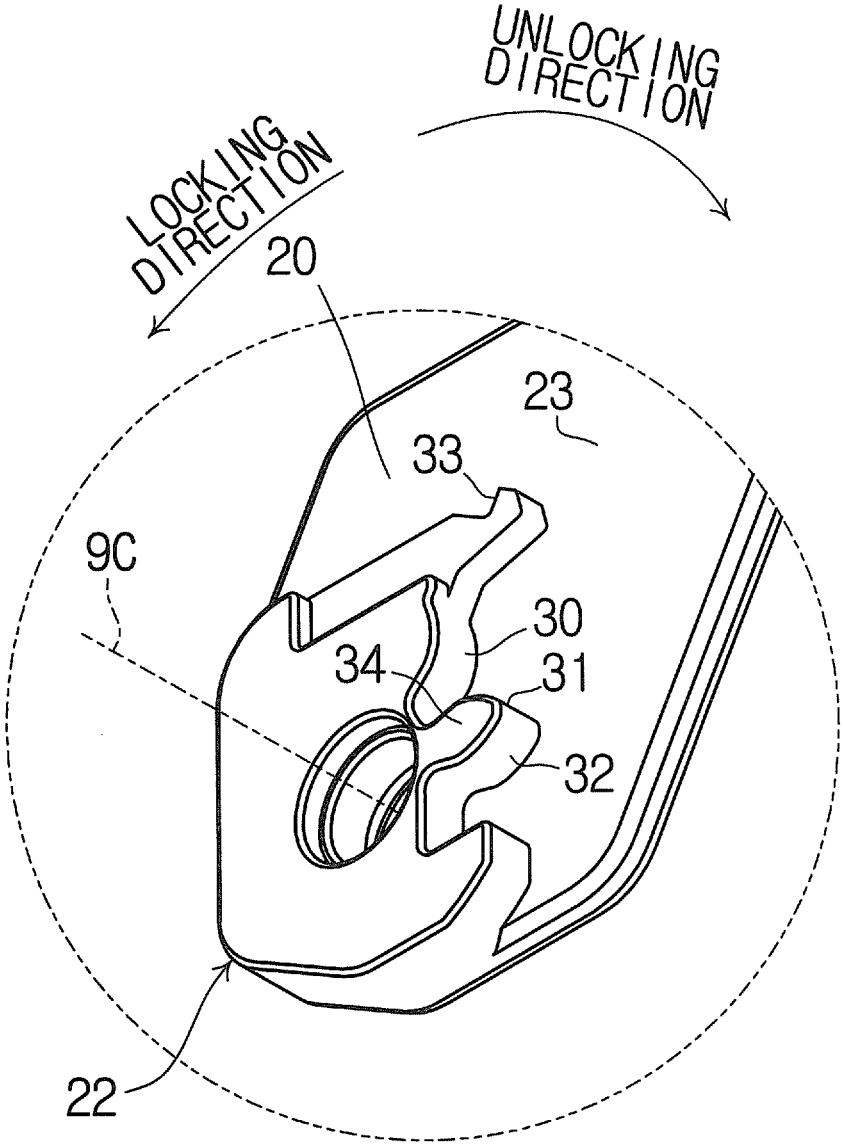
FIG. 5 is an enlarged view showing a portion "A" shown in FIG. 4.
Figure 6:
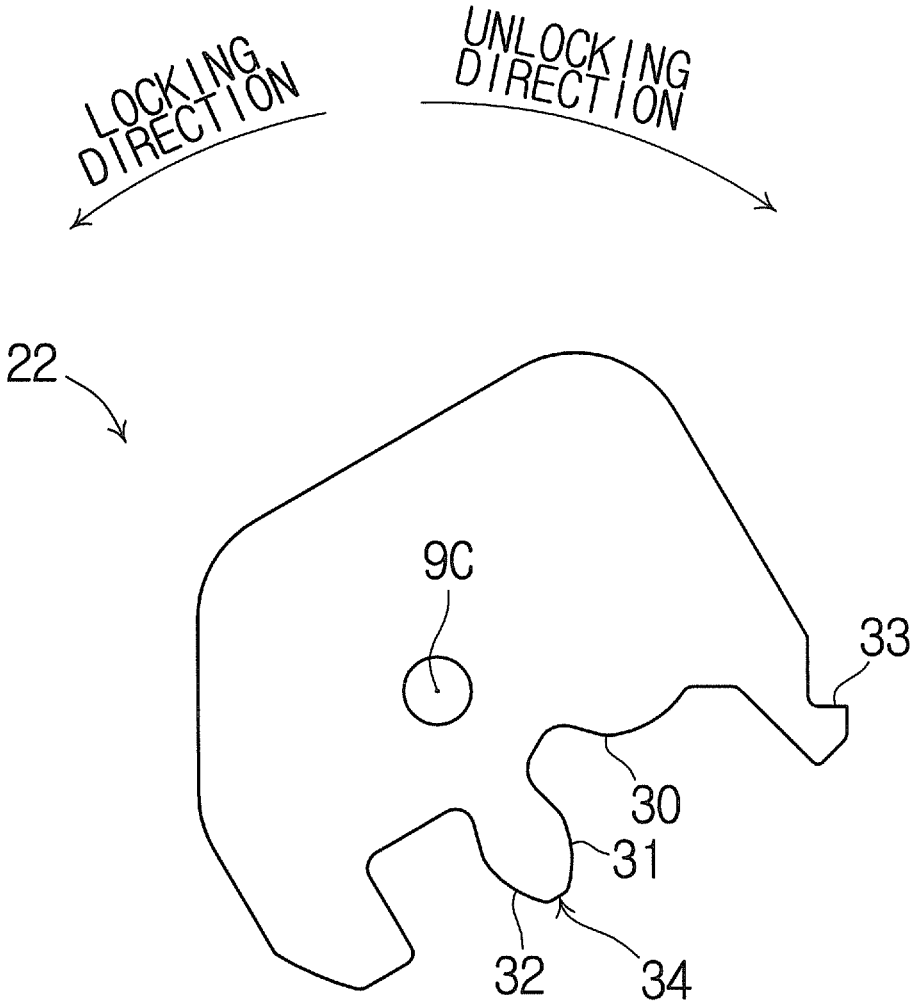
FIG. 6 is an elevation view of a pinion.

Referring next to FIGS. 5 and 6, the pinions 22 will be described. FIG. 5 is an enlarged view of a portion "A" shown in FIG. 4. FIG. 6 illustrates only one of the pinions 22 in a simplified manner. As shown in FIGS. 5 and 6, the pinion 22 is formed in the vicinity of the lever rotation axis 9C. The pinion 22 includes a pinion first driven surface 30 (lever driven surface), a pinion driving surface 31 (lever driving surface), a pinion second driven surface 32, and a pinion temporary holding surface 33. The pinion first driven surface 30, the pinion driving surface 31, and the pinion second driven surface 32 are arranged in this order in the unlocking direction. The pinion first driven surface 30 is a surface that faces in the unlocking direction. The pinion driving surface 31 is a surface that faces in the locking direction and is opposed to the pinion first driven surface 30 in the rotation direction of the lever 9. The pinion second driven surface 32 is a surface that faces in the unlocking direction. A pinion tooth 34 is formed between the pinion driving surface 31 and the pinion second driven surface 32. The pinion driving surface 31 and the pinion second driven surface 32 each correspond to the tooth surface of the pinion tooth 34. The pinion temporary holding surface 33 is opposite to the lever rotation axis 9C with the pinion first driven surface 30 interposed therebetween.

Figure 7:
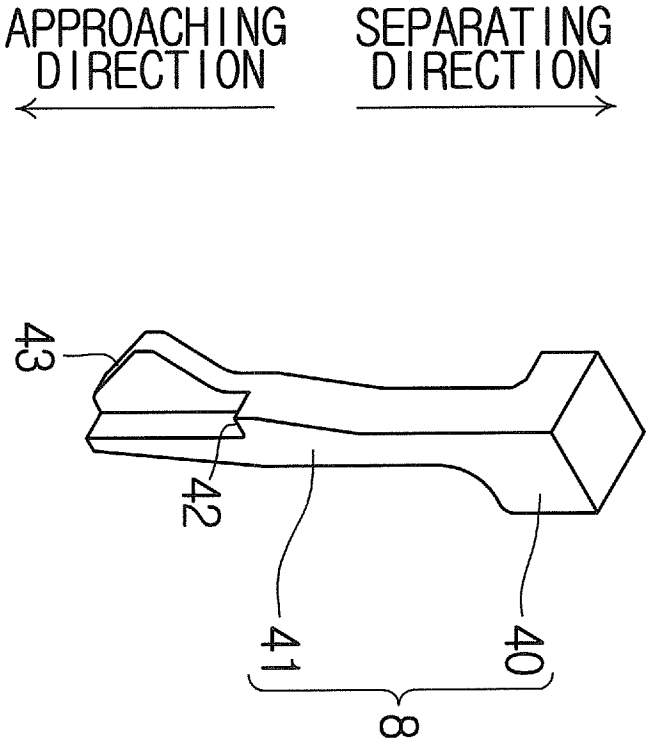
FIG. 7 is a perspective view of a temporary holding spring.
Figure 8:
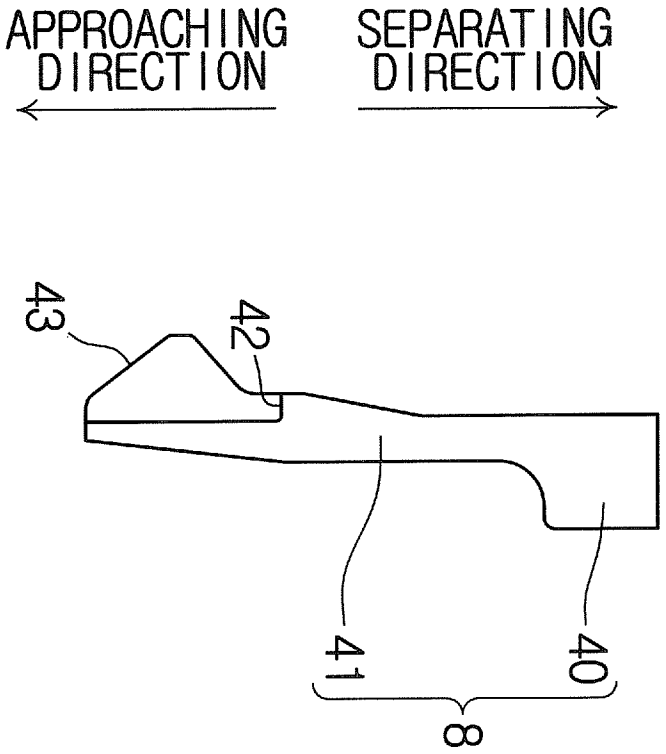
FIG. 8 is an elevation view of the temporary holding spring.

Referring next to FIGS. 7 and 8, the temporary holding spring 8 will be described. As shown in FIGS. 7 and 8, the temporary holding spring 8 includes a fixed portion 40 and an elastic beam 41. The fixed portion 40 is fixed to the plug hood 10 (also see FIG. 2). The elastic beam 41 extends in the approaching direction from the fixed portion 40. The elastic beam 41 has a temporary-holding execution surface 42 and a temporary-holding releasing operation surface 43. The temporary-holding execution surface 42 is a surface that faces in the approaching direction. The temporary-holding releasing operation surface 43 is a surface that faces in the approaching direction and is formed with a slope.

Figure 9:
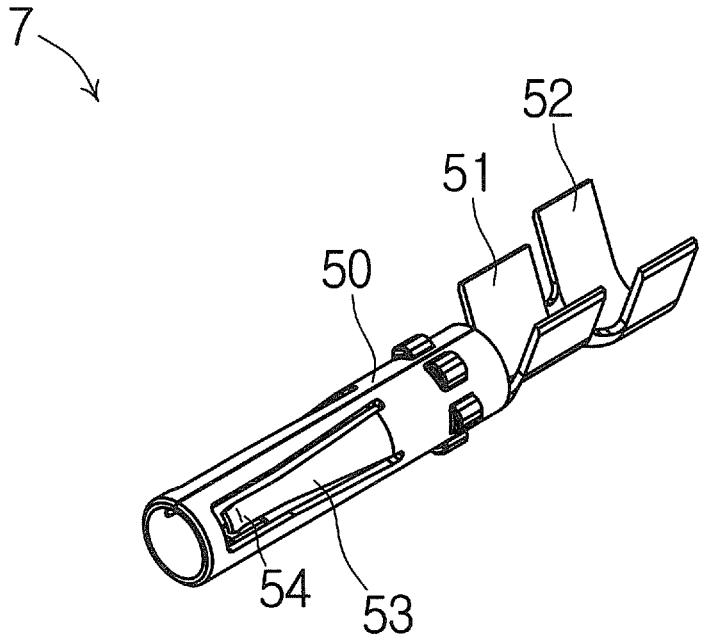
FIG. 9 is a perspective view of a plug contact.

Referring next to FIG. 9, the plug contacts 7 will be described. As shown in FIG. 9, each plug contact 7 is a socket contact. Specifically, the plug contact 7 includes a socket portion 50 having a cylindrical shape, an open barrel conductor grip 51, an open barrel insulation grip 52, and a contact piece 53 (plug contact portion). The contact piece 53 is formed as a part of a peripheral wall of the socket portion 50. The contact piece 53 is supported by the socket portion 50 in a cantilever manner. A contact point 54 that curves in a convex shape toward the central axis of the socket portion 50 is formed at a tip of the contact piece 53.

Figure 10:
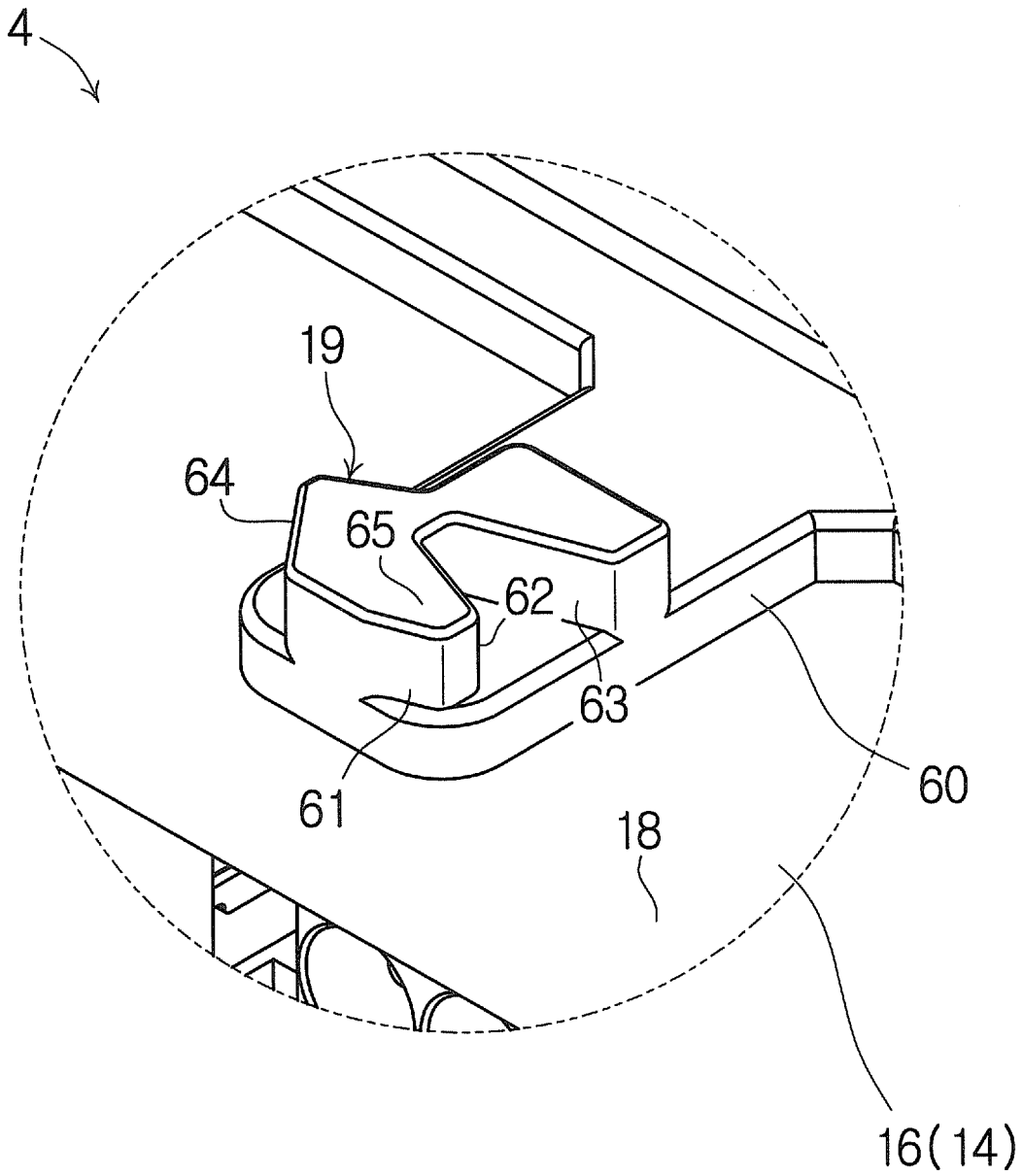
FIG. 10 is a perspective view of a rack.
Figure 11:
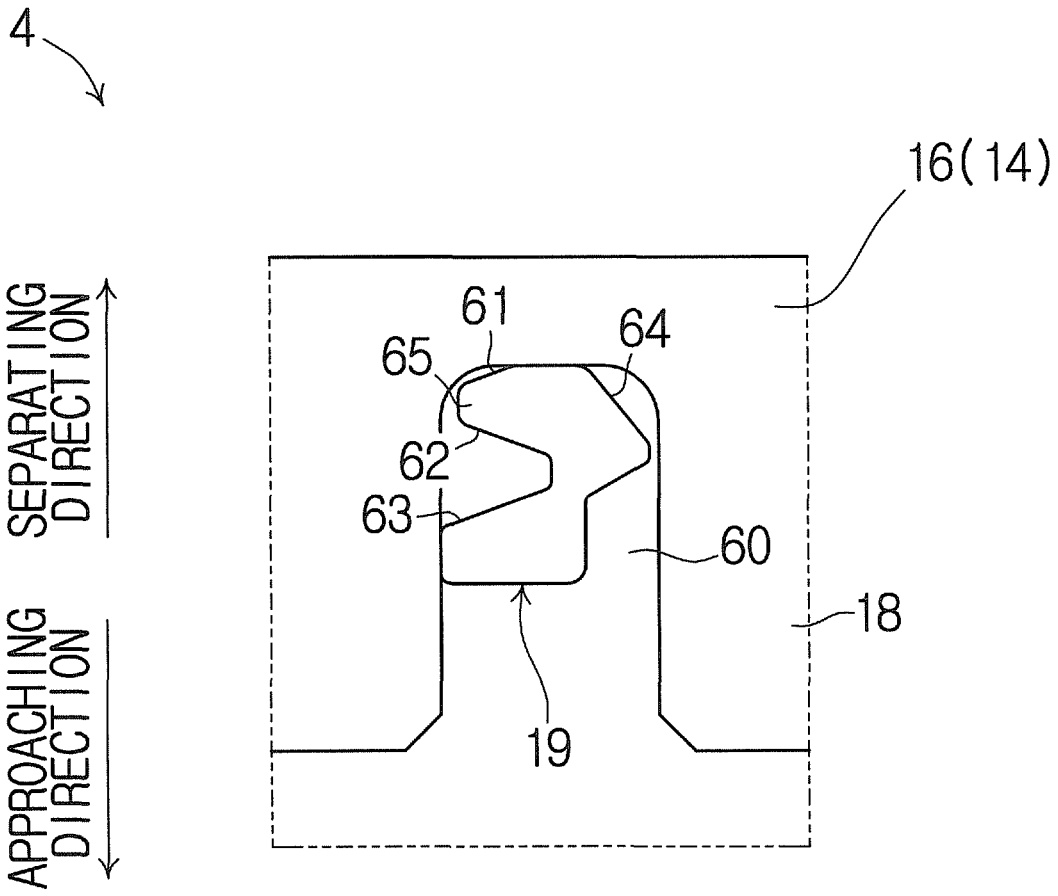
FIG. 11 is an elevation view of the rack.

Referring next to FIGS. 10 and 11, the racks 19 will be described. FIG. 10 is a perspective view showing one of the racks 19. FIG. 11 illustrates the rack 19 in a simplified manner. As shown in FIG. 10, a rack table 60 is formed on the outer surface 18 of the receptacle shell 16 in such a manner that the rack table 60 projects from the outer surface 18. The rack 19 is formed on the rack table 60 in such a manner that the rack 19 projects from the rack table 60. As shown in FIGS. 10 and 11, the rack 19 includes a rack first driving surface 61 (receptacle driving surface), a rack driven surface 62 (receptacle driven surface), a rack second driving surface 63, and a temporary-holding release execution surface 64. The rack first driving surface 61, the rack driven surface 62, and the rack second driving surface 63 are arranged in this order in the approaching direction. The rack first driving surface 61 faces in the separating direction and is inclined. The rack driven surface 62 faces in the approaching direction and is inclined. The rack second driving surface 63 faces in the separating direction and is inclined. The rack second driving surface 63 is opposed to the rack driven surface 62 in the movement direction of the plug 3. A rack tooth 65 is formed between the rack first driving surface 61 and the rack driven surface 62. The rack first driving surface 61 and the rack driven surface 62 each correspond to the tooth surface of the rack tooth 65. The temporary-holding release execution surface 64 faces in the separating direction and is inclined.

Figure 12:
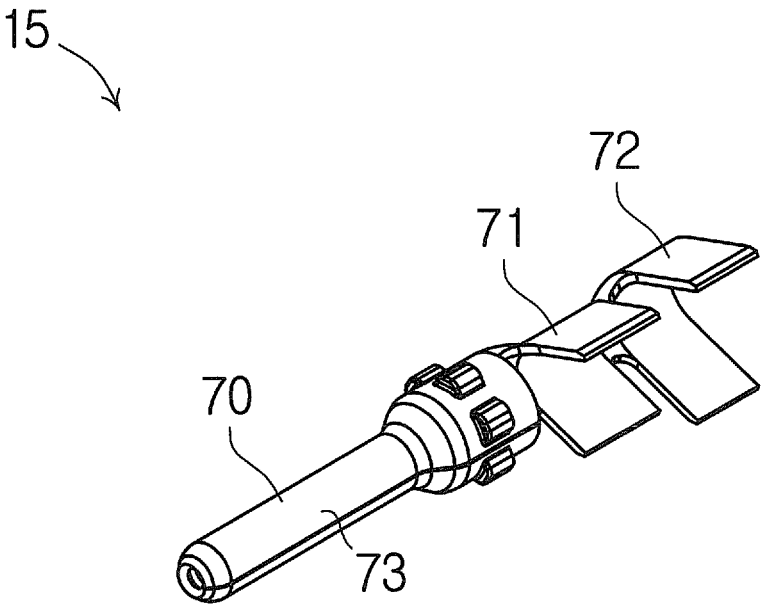
FIG. 12 is a perspective view of a receptacle contact.

Referring next to FIG. 12, the receptacle contacts 15 will be described. As shown in FIG. 12, each receptacle contact 15 is a pin contact. Specifically, the receptacle contact 15 includes a pin portion 70 (receptacle contact portion) having a round bar shape, an open barrel conductor grip 71, and an open barrel insulation grip 72. The pin portion 70 has an outer peripheral surface 73.

Referring next to FIGS. 13 to 24, the mating operation of the lever connector 1 will be described.

Figure 13:
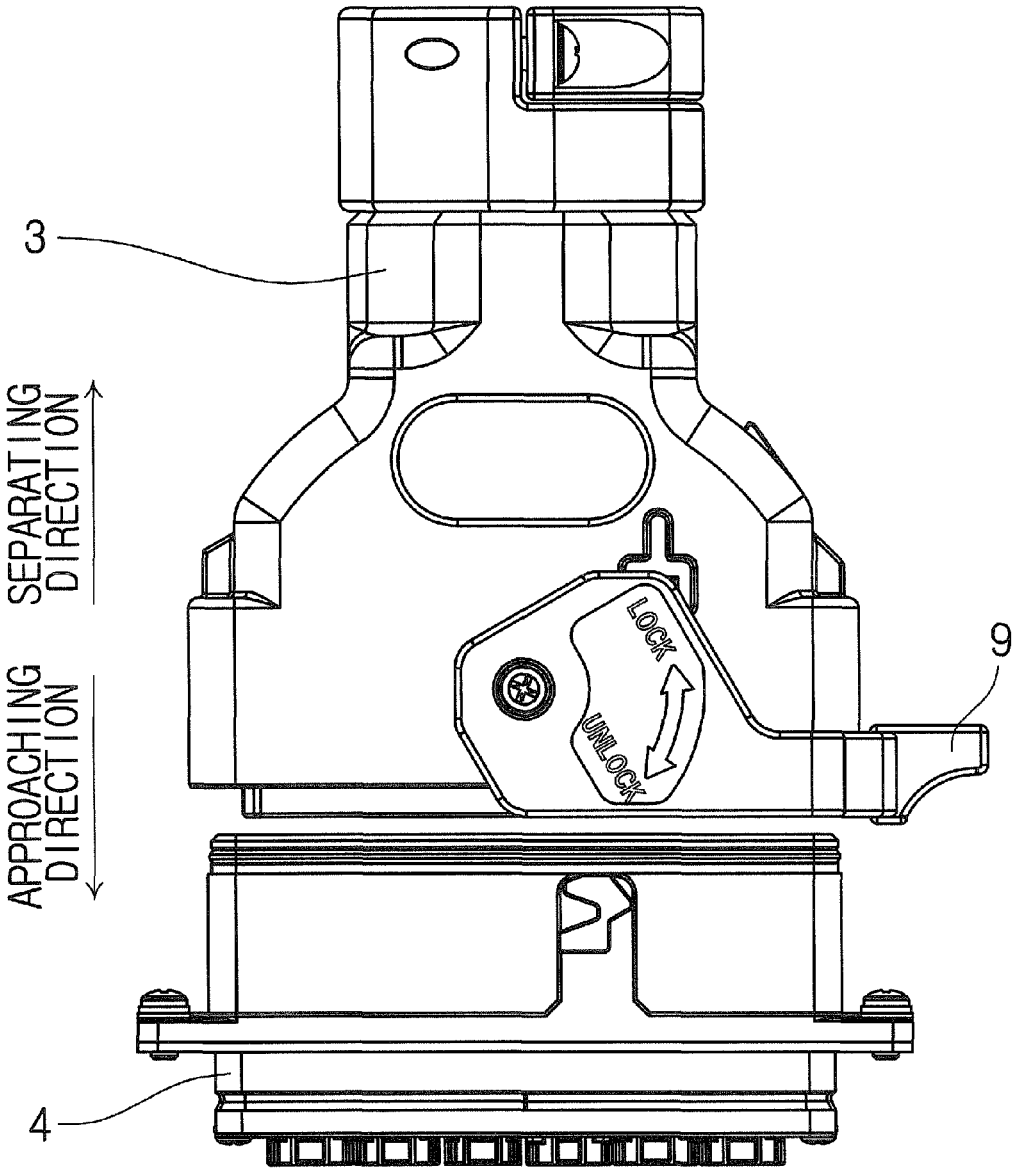
FIG. 13 is an elevation view showing a lever connector in a state where a plug and a receptacle confront each other.
Figure 14:
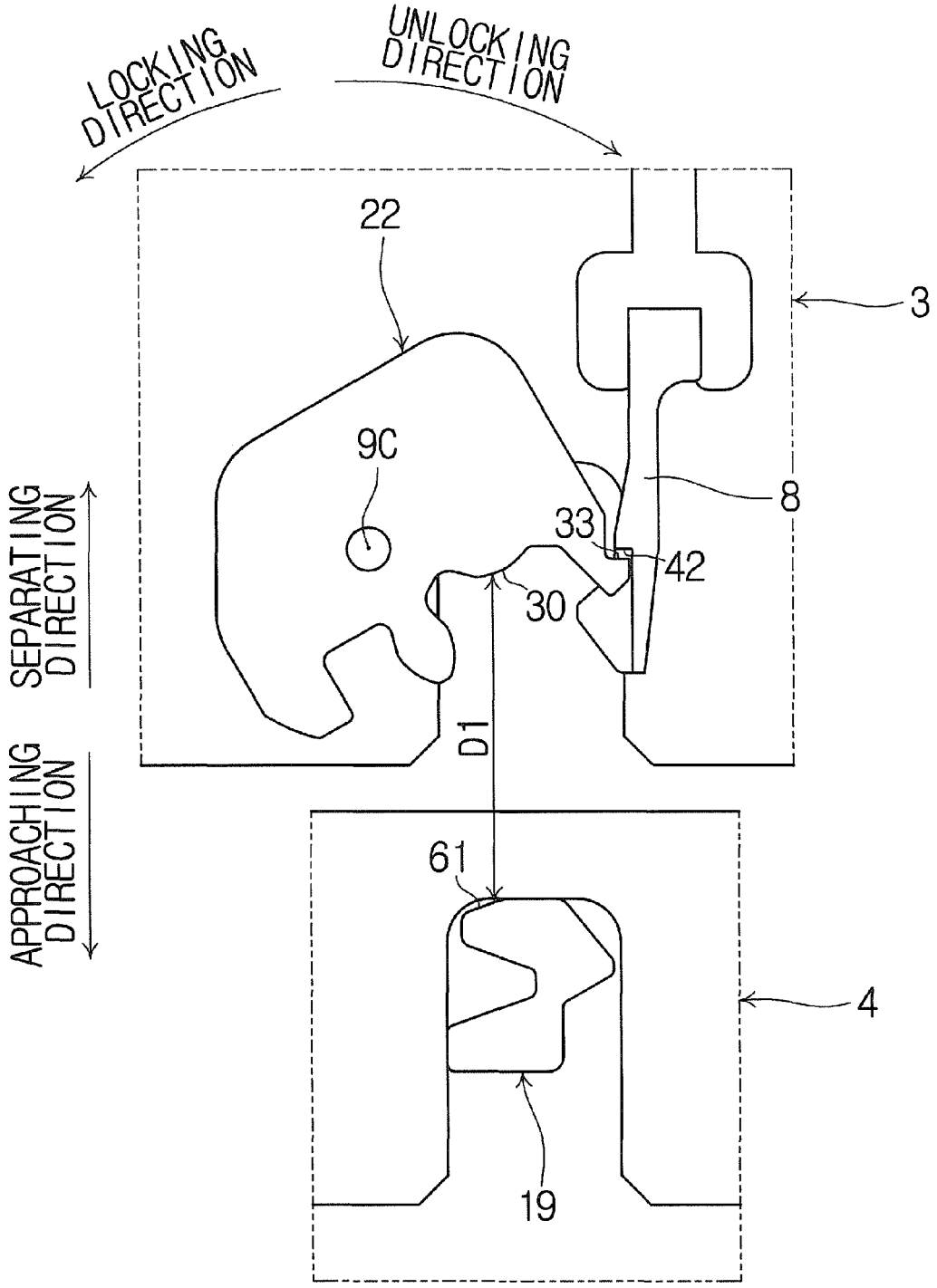
FIG. 14 is a diagram showing a pinion and a rack in a state where the plug and the receptacle confront each other.
Figure 15:
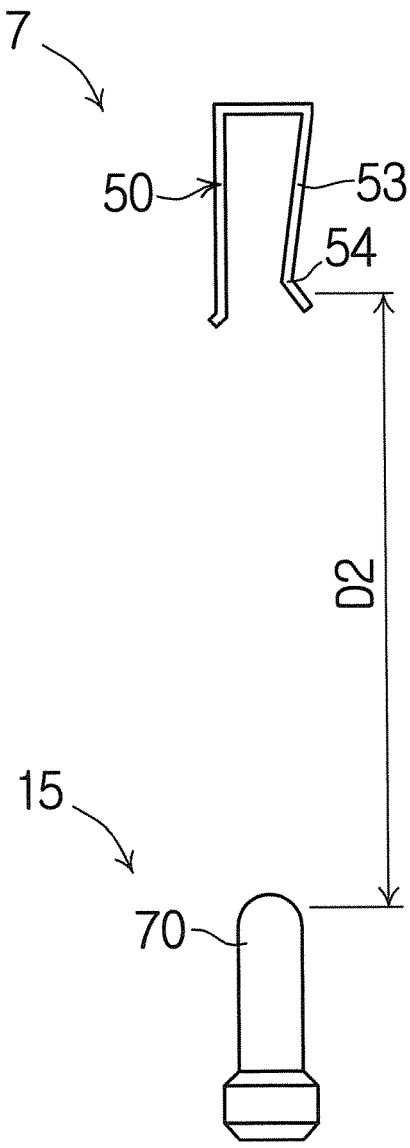
FIG. 15 is a diagram showing a plug contact and a receptacle contact in a state where the plug and the receptacle confront each other.

First, as shown in FIG. 13, the plug 3 and the receptacle 4 confront each other with a slight gap therebetween so that the plug 3 and the receptacle 4 are mated together. FIG. 14 illustrates the pinion 22, the rack 19, and the temporary holding spring 8 in a simplified manner in the state shown in FIG. 13. In the state shown in FIG. 13, the pinion temporary holding surface 33 of the pinion 22 is opposed to the temporary-holding execution surface 42 of the temporary holding spring 8 in the rotation direction of the lever 9 as shown in FIG. 14. That is, the pinion temporary holding surface 33 hooks on to the temporary-holding execution surface 42. This inhibits the rotation of the lever 9 in the locking direction in the state shown in FIG. 13. In other words, the temporary holding spring 8 temporarily holds the lever 9 at an unlock position. Further, as shown in FIG. 14, the pinion first driven surface 30 of the pinion 22 is opposed to the rack first driving surface 61 of the rack 19 in the approaching direction. FIG. 14 shows a clearance D1 (distance) between the pinion first driven surface 30 and the rack first driving surface 61 in the approaching direction. FIG. 15 illustrates the plug contact 7 and the receptacle contact 15 in a simplified manner in the state shown in FIG. 13. FIG. 15 shows a clearance D2 between the contact point 54 of the contact piece 53 of the plug contact 7 and the pin portion 70 of the receptacle contact 15. In this exemplary embodiment, the relation between the clearance D1 and the clearance D2 is expressed as D1<D2.

Figure 16:
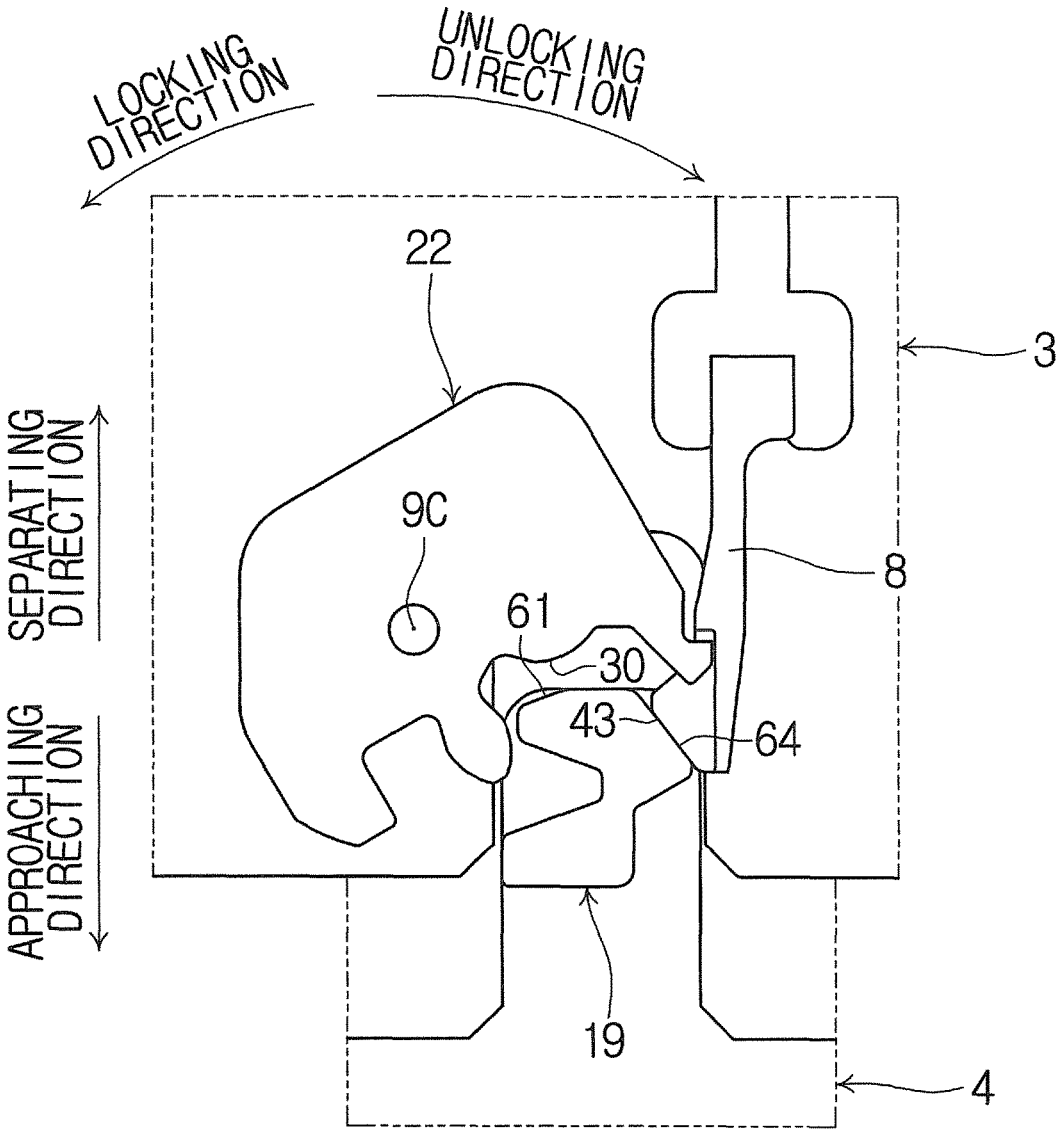
FIG. 16 is a diagram showing a state where the plug is moved toward the receptacle, thereby bringing the temporary holding spring into contact with the rack.
Figure 17:
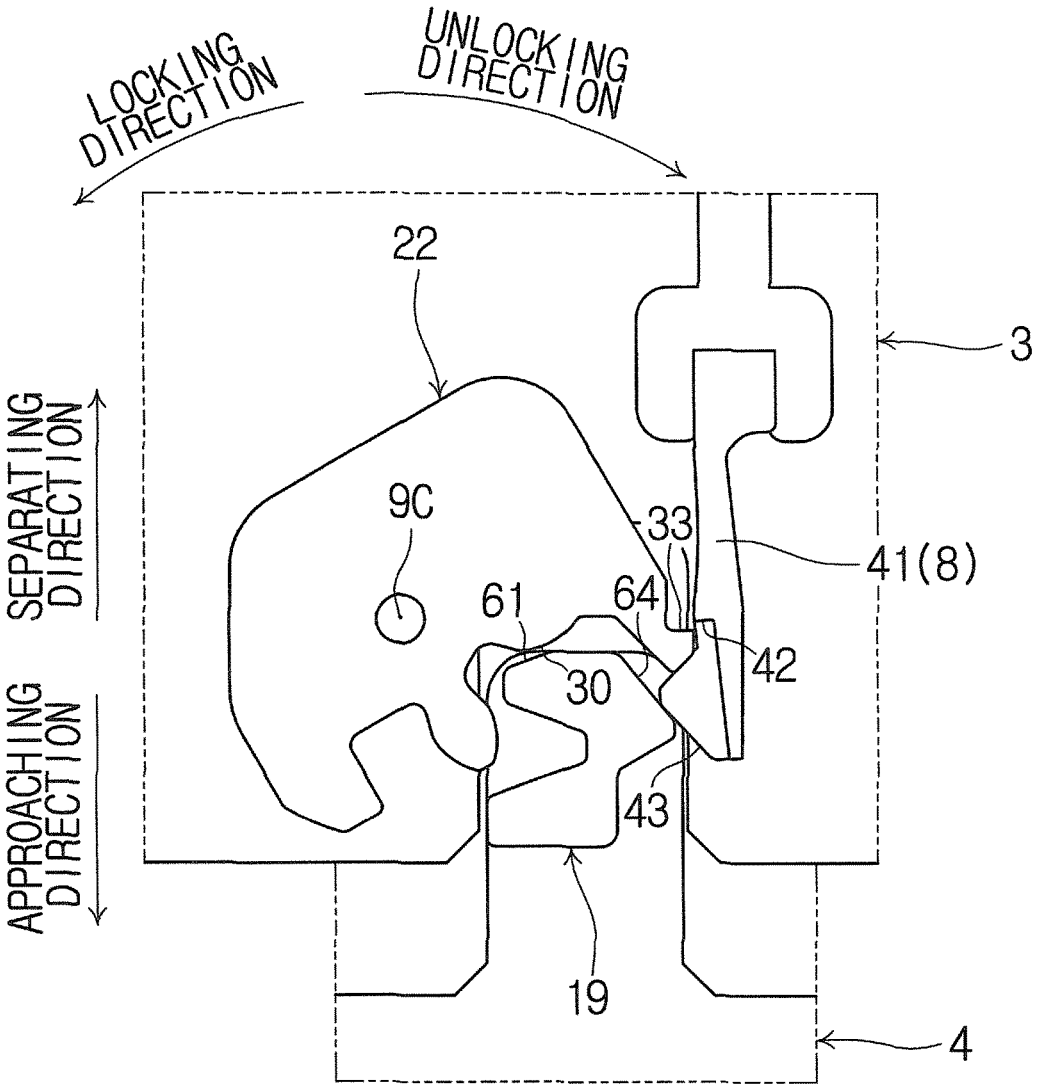
FIG. 17 is a diagram showing a state where the plug is further moved toward the receptacle from the state shown in FIG. 16, thereby causing the temporary holding spring to be elastically deformed and releasing the temporary holding.
Figure 18:
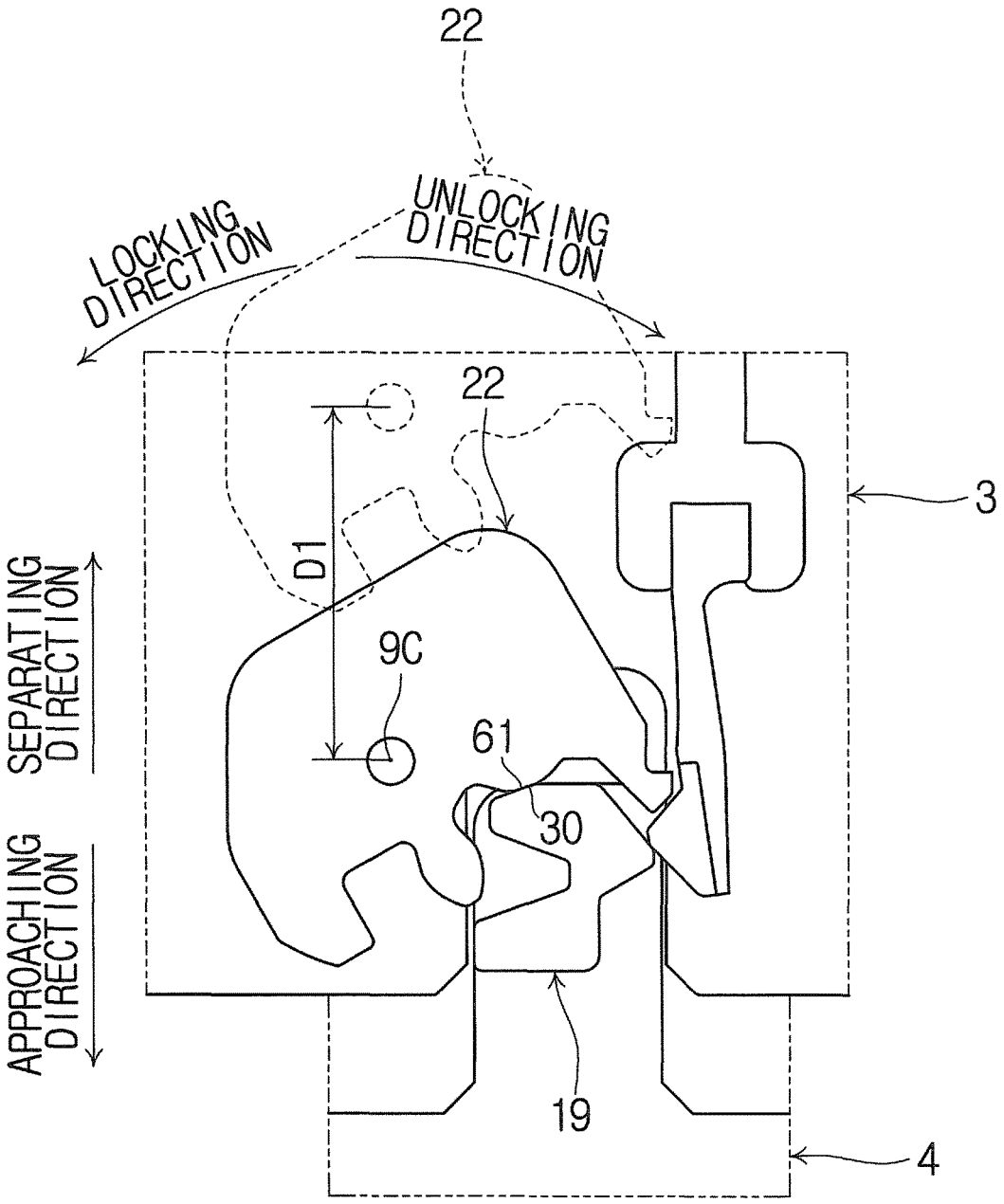
FIG. 18 is a diagram showing a state where the plug is further moved toward the receptacle from the state shown in FIG. 17, thereby bringing a rack first driving surface into contact with a pinion first driven surface.

FIGS. 16 to 18 sequentially illustrate the operations of the pinion 22, the rack 19, and the temporary holding spring 8 when the plug 3 is moved toward the receptacle 4 from the state shown in FIG. 13.

When the plug 3 is moved toward the receptacle 4 from the state shown in FIG. 13, as shown in FIG. 16, the temporary-holding release execution surface 64 of the rack 19 is first brought into contact with the temporary-holding releasing operation surface 43 of the temporary holding spring 8. In the state shown in FIG. 16, there is still a gap between the pinion first driven surface 30 of the pinion 22 and the rack first driving surface 61 of the rack 19.

When the plug 3 is further moved toward the receptacle 4, as shown in FIG. 17, the temporary-holding releasing operation surface 43 is pressed away by the temporary-holding release execution surface 64 along with the elastic deformation of the elastic beam 41 of the temporary holding spring 8, with the result that the opposing relationship between the temporary-holding execution surface 42 and the pinion temporary holding surface 33 in the approaching direction ceases. Accordingly, the temporary holding of the lever 9 by the temporary holding spring 8 is released, which allows the rotation of the lever 9 in the locking direction. In the state shown in FIG. 17, there is still a gap between the pinion first driven surface 30 and the rack first driving surface 61.

When the plug 3 is further moved toward the receptacle 4, as shown in FIG. 18, the pinion first driven surface 30 and the rack first driving surface 61 are brought into contact with each other. The distance of the movement of the plug 3 toward the receptacle 4 until the pinion first driven surface 30 is brought into contact with the rack first driving surface 61 from the state shown in FIG. 14 is equal to the clearance D1 shown in FIG. 14.

Figure 19:
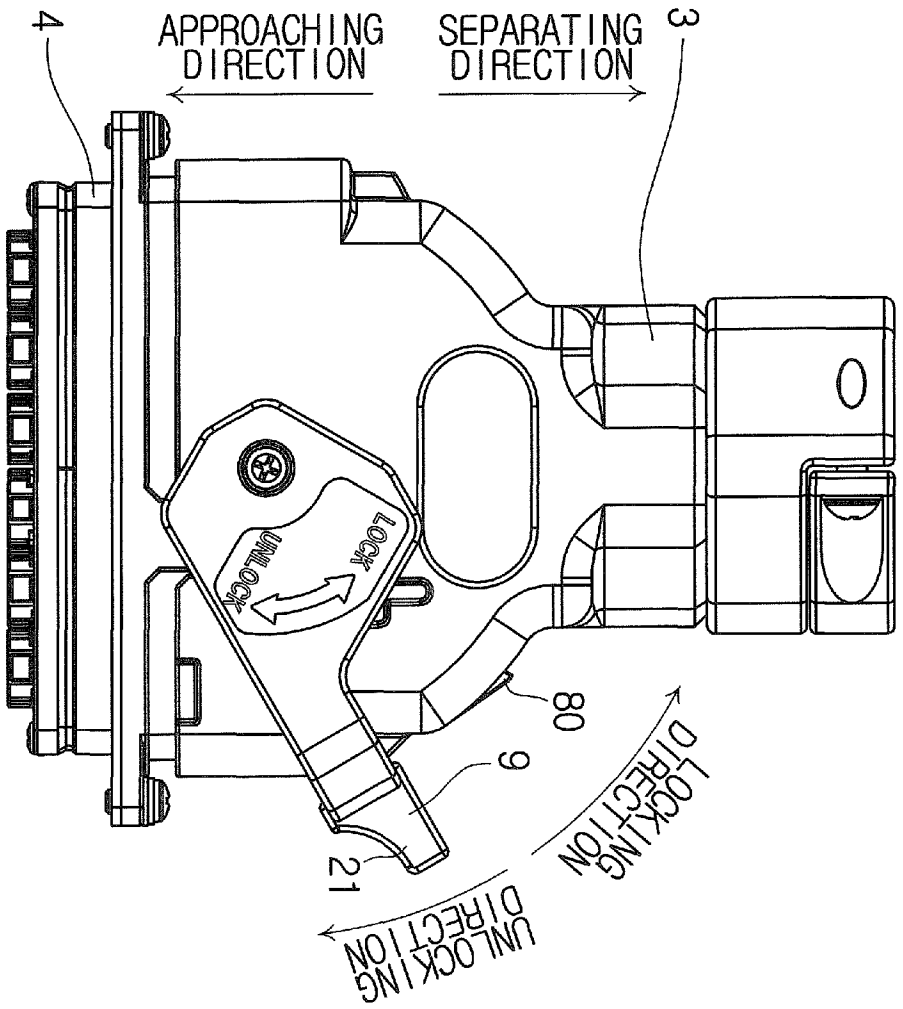
FIG. 19 is a diagram showing a state where the plug is further moved toward the receptacle from the state shown in FIG. 18, thereby causing the lever to automatically rotate by about 30 degrees in a locking direction.
Figure 20:
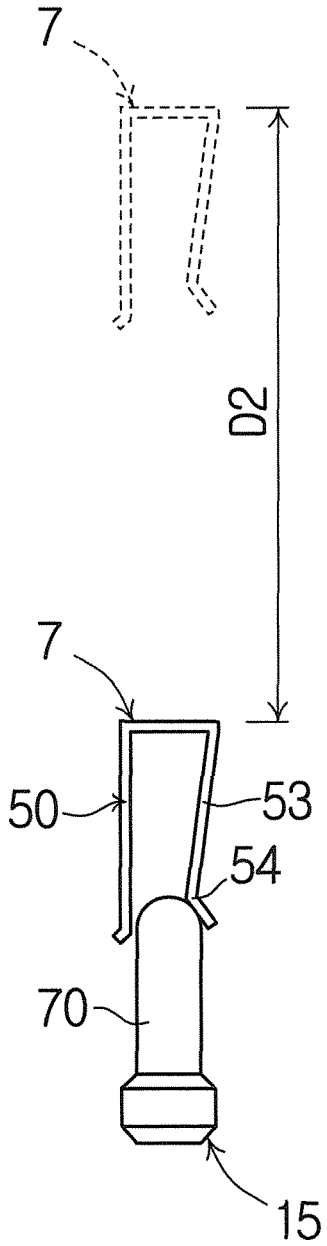
FIG. 20 is a diagram showing the plug contact and the receptacle contact in the state shown in FIG. 19.

FIG. 19 shows a state where the lever 9 automatically rotates when the plug 3 is further moved toward the receptacle 4 from the state shown in FIG. 18. FIG. 20 illustrates the plug contact 7 and the receptacle contact 15 in a simplified manner in the state shown in FIG. 19. When the plug 3 is further moved toward the receptacle 4 from the state shown in FIG. 18, as shown in FIG. 19, the lever 9 automatically rotates in the locking direction for the following reasons. A first reason is that the pinion 22 is rotatable in the locking direction. A second reason is that since the pinion first driven surface 30 is in contact with the rack first driving surface 61, the movement of the pinion first driven surface 30 in the approaching direction is restricted, so that a moment about the lever rotation axis 9C acts on the lever 9. A third reason is that since there is still a gap between the contact point 54 of the plug contact 7 shown in FIG. 15 and the pin portion 70 of the receptacle contact 15, no resistance force is generated against the movement of the plug 3 toward the receptacle 4.

Figure 21:
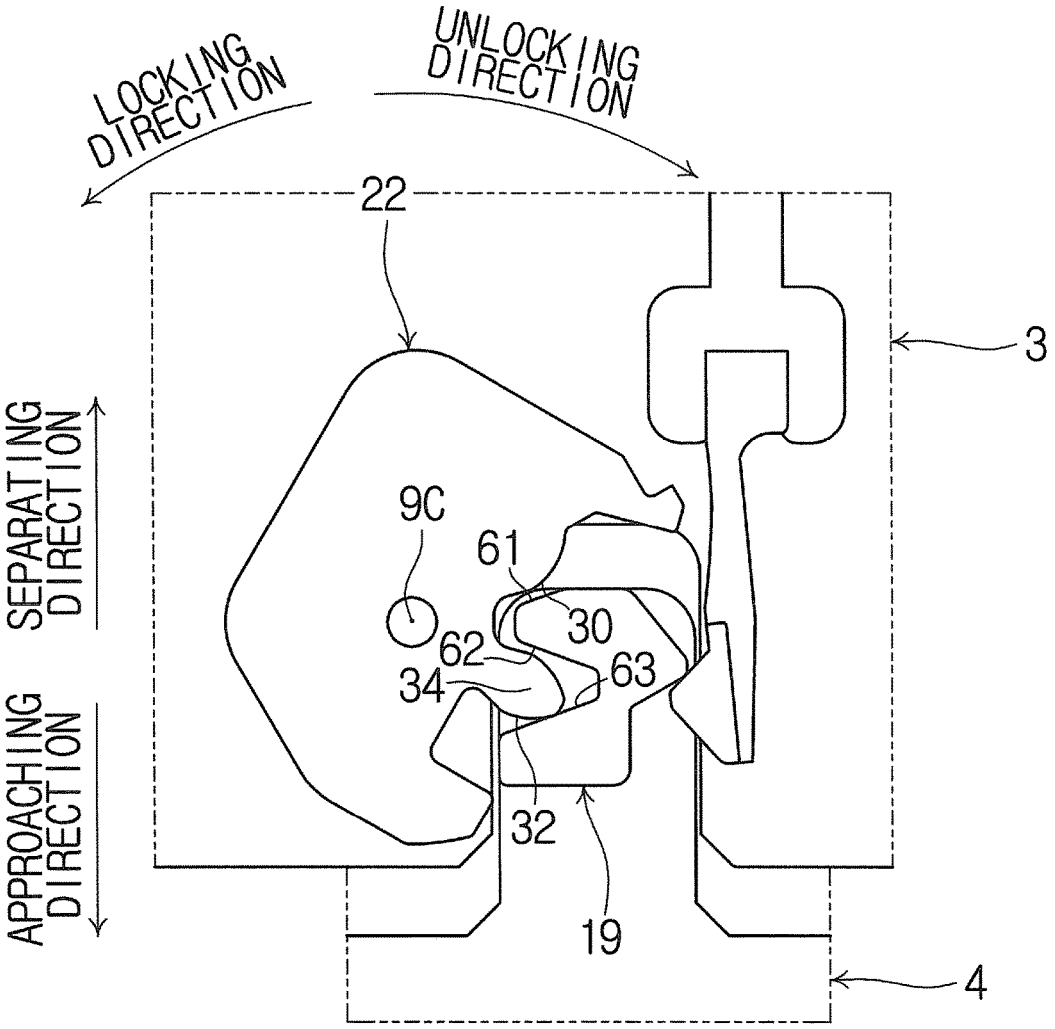
FIG. 21 is a diagram showing the pinion and the rack in the state shown in FIG. 19.

However, as shown in FIG. 19, when the lever 9 is rotated by about 30 degrees, the automatic rotation of the lever 9 suddenly stops, which makes it extremely difficult to further move the plug 3 toward the receptacle 4 for the following reasons. A first reason is that, as shown in FIG. 20, when the pin portion 70 of each receptacle contact 15 is brought into contact with the contact point 54 of the contact piece 53 of the corresponding plug contact 7, a resistance force is generated against the insertion of the pin portion 70 of each receptacle contact 15 into the socket portion 50 of the corresponding plug contact 7. A second reason is that since the lever connector 1 of this exemplary embodiment is a multi-contact connector including 80 cores, the resistance force is generated at 80 locations in the same manner. In other words, at the time when the lever 9 is rotated by about 30 degrees, an extremely strong resistance force is generated against the movement of the plug 3 toward the receptacle 4. Note that the distance of the movement of the plug 3 toward the receptacle 4 until the contact point 54 of the plug contact 7 is brought into contact with the pin portion 70 of the receptacle contact 15 from the state shown in FIG. 15 is equal to the clearance D2 shown in FIG. 15. FIG. 21 shows the state of the pinion 22 and the rack 19 when the lever 9 is rotated by about 30 degrees. As shown in FIG. 21, in the state where the lever 9 is rotated by about 30 degrees, the pinion first driven surface 30 is already separated from the rack first driving surface 61, and instead the pinion second driven surface 32 is in contact with the rack second driving surface 63. The pinion tooth 34 is inserted between the rack driven surface 62 and the rack second driving surface 63.

Figure 22:
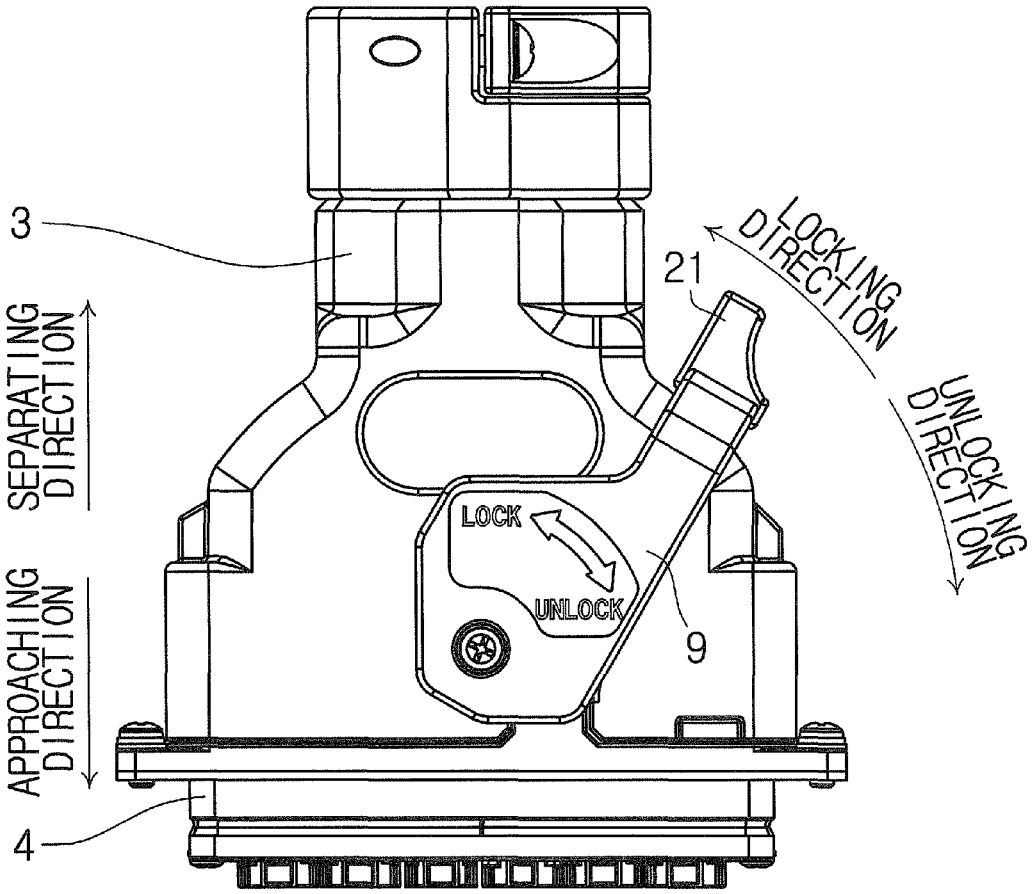
FIG. 22 is an elevation view showing the lever connector in a state where the lever is rotated to a lock position.
Figure 23:
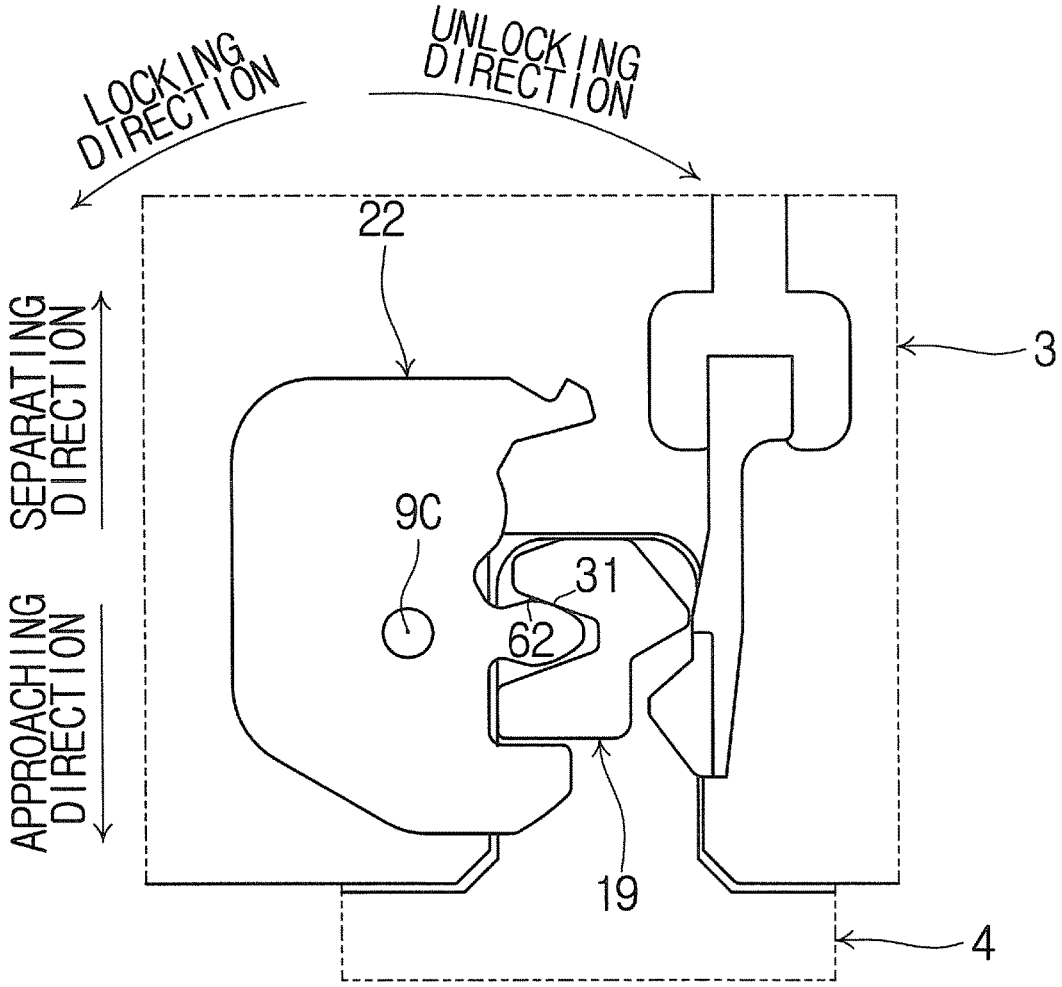
FIG. 23 is a diagram showing the pinion and the rack in the state shown in FIG. 22.
Figure 24:
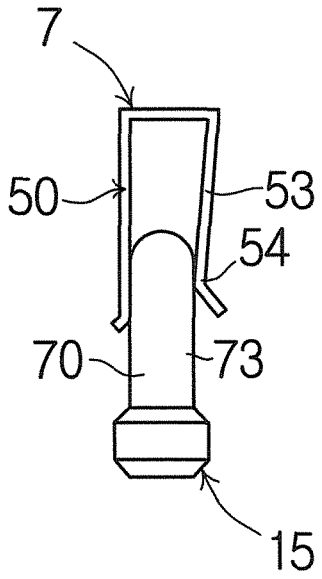
FIG. 24 is a diagram showing the plug contact and the receptacle contact in the state shown in FIG. 22.

FIG. 22 shows a state where the lever 9 is manually rotated in the locking direction with a finger hooked on the lever operating portion 21 of the lever 9 in the state shown in FIG. 19. FIG. 23 shows the state of the pinion 22 and the rack 19 when the lever 9 is manually rotated. As shown in FIG. 22, when the lever 9 is manually rotated in the locking direction, the pinion 22 and the rack 19 collaborate with each other and exert a boosting effect specific to the rack-and-pinion mechanism as shown in FIG. 23. As a result, the receptacle 4 is strongly pulled toward the plug 3. At this time, the pinion 22 and the rack 19 operate together in a state where the pinion driving surface 31 of the pinion 22 is constantly in contact with the rack driven surface 62 of the rack 19. FIG. 24 illustrates the plug contact 7 and the receptacle contact 15 in a simplified manner when the lever 9 is manually rotated in the locking direction. As shown in FIG. 24, when the lever 9 is manually rotated in the locking direction, the receptacle 4 is strongly pulled toward the plug 3. As a result, the pin portion 70 of each receptacle contact 15 is inserted into the socket portion 50 of the corresponding plug contact 7 along with the elastic deformation of the contact piece 53 of the plug contact 7, and the contact point 54 is brought into electrical contact with the outer peripheral surface 73 of the pin portion 70.

As a result of manually rotating the lever 9, as shown in FIG. 22, the lever 9 is rotated by about 60 degrees in total from the unlock position shown in FIG. 13. Then, the lever lock spring 24 of the lever 9 shown in FIG. 4 hooks on to a lock position holding projection 80 of the plug 3 shown in FIG. 19, so that the lever 9 is held at a lock position shown in FIG. 22. Thus, the mating operation of the lever connector 1 is completed.

The exemplary embodiment described above has the following features.

(1) The lever connector 1 includes the plug 3 and the receptacle 4. The plug 3 includes: the plug contacts 7 each including the contact piece 53 (plug contact portion); the plug housing 6 that holds the plug contacts 7; and the lever 9 that is rotatably attached to the plug housing 6. The receptacle 4 includes: the receptacle contacts 15 each including the pin portion 70 (receptacle contact portion) capable of coming into contact with the contact piece 53; and the receptacle housing 14 that holds the receptacle contacts 15. The plug 3 and the receptacle 4 are pulled together by the rotation of the lever 9 in the locking direction (first rotation direction). The lever 9 has the pinion first driven surface 30 (lever driven surface) that faces in the unlocking direction (second rotation direction) that is opposite to the locking direction. The receptacle housing 14 has the rack first driving surface 61 (receptacle driving surface) that faces in the separating direction that is opposite to the approaching direction in which the plug 3 is caused to approach the receptacle 4 so as to mate the plug 3 with the receptacle 4. In a state where the plug 3 confronts the receptacle 4 so as to mate the plug 3 with the receptacle 4, the clearance D1 (distance) between the pinion first driven surface 30 and the rack first driving surface 61 is smaller than the clearance D2 (distance) between the contact piece 53 and the pin portion 70. When the plug 3 is moved toward the receptacle 4, the pinion first driven surface 30 is first brought into contact with the rack first driving surface 61, and then the lever 9 is rotated in the locking direction, and after that, the contact piece 53 is brought into contact with the pin portion 70. According to the above structure, the lever 9 can be automatically rotated in the locking direction only by moving the plug 3 toward the receptacle 4. Therefore, a workload on an operator during mating of the lever connector 1 can be reduced compared to a case where the operator is involved in the entire process of rotating the lever 9 in the locking direction.

Figure 25:
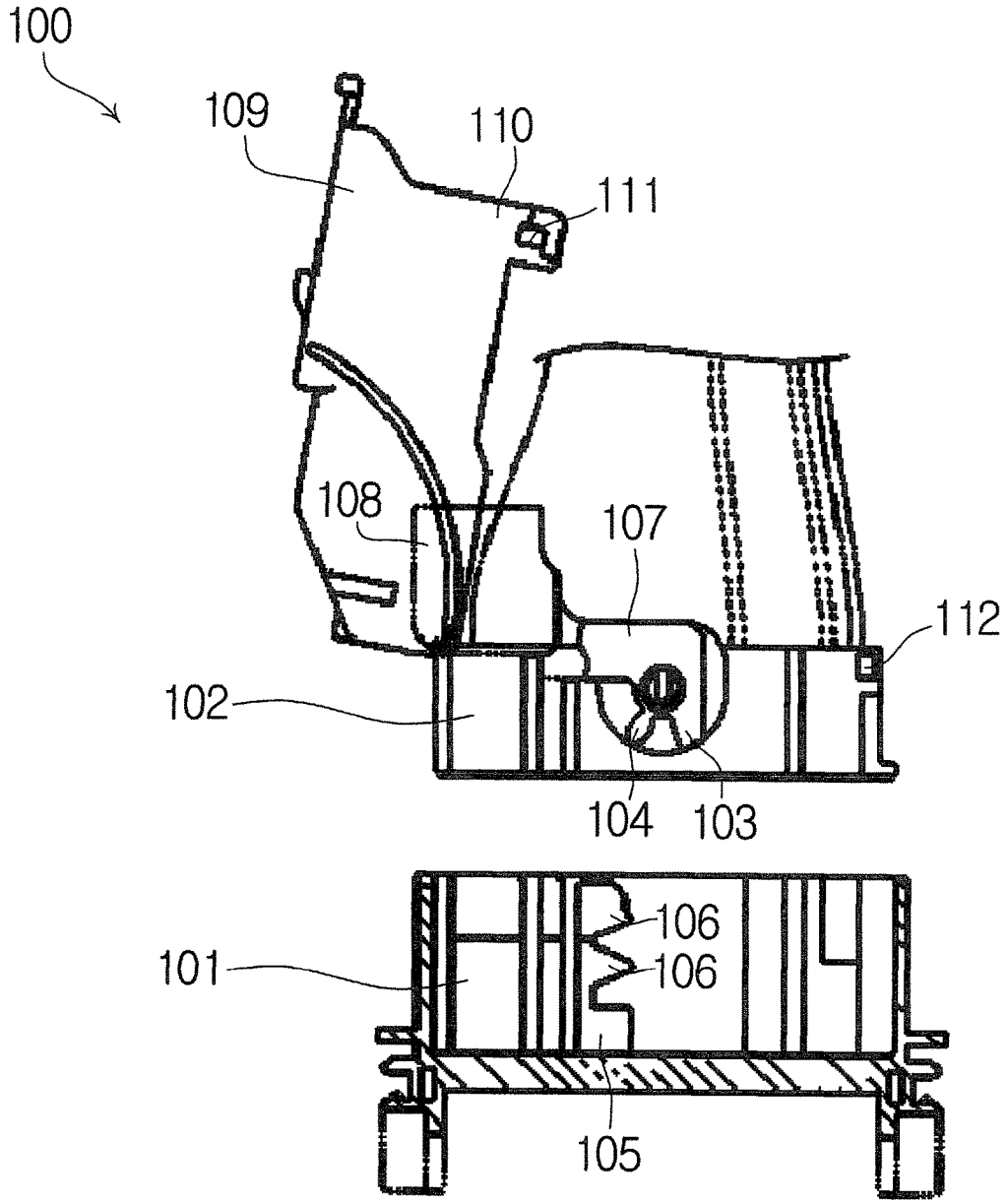
FIG. 25 is a diagram corresponding to FIG. 1 of Japanese Unexamined Patent Application Publication No. 2013-4419.

Note that in Japanese Unexamined Patent Application Publication No. 2013-4419, it is assumed that the automatic rotation of the lever as described above does not occur. This is because, as shown in FIG. 25 of this application, the lever 107 is structured so as to interlock with the cover 109, and if the lever 107 automatically rotates, the cover 109 also rotates in accordance with the rotation of the lever 107, which may injure the hand of the operator gripping the housing 102.

(2) The plug 3 also includes the temporary holding spring 8 (lever temporary holding mechanism) that temporarily holds the lever 9 in such a manner that the pinion first driven surface 30 and the rack first driving surface 61 are opposed to each other in the approaching direction in a state where the plug 3 confronts the receptacle 4 so as to mate the plug 3 with the receptacle 4. The temporary holding spring 8 is a temporary holding elastic piece that is supported by the plug housing 6 in a cantilever manner. The temporary holding spring 8 hooks on to the lever 9, thereby inhibiting the rotation of the lever 9 in the locking direction. When the plug 3 is moved toward the receptacle 4, the temporary holding spring 8 is brought into contact with the receptacle 4 and elastically deformed. The elastic deformation releases the inhibited state of the lever 9. According to the above structure, when the plug 3 confronts the receptacle 4 so as to mate the plug 3 with the receptacle 4, there is no need for the operator to correct the position of the lever 9 and place the pinion first driven surface 30 and the rack first driving surface 61 so as to be opposed to each other. Consequently, the workload on the operator can be reduced.

(3) The lever 9 has the pinion driving surface 31 (lever driving surface) that faces in the locking direction. The receptacle housing 14 has the rack driven surface 62 (receptacle driven surface) that faces in the approaching direction. When the lever 9 is rotated in the locking direction in a state where the contact piece 53 is in contact with the pin portion 70, the pinion driving surface 31 comes into contact with the rack driven surface 62. According to the above structure, the plug 3 and the receptacle 4 can be pulled together.

The preferred exemplary embodiment of the present invention described above can be modified as follows.

In the exemplary embodiment described above, as shown in FIG. 15, a socket contact is used as the plug contact 7 and a pin contact is used as the receptacle contact 15. Alternatively, a pin contact may be used as the plug contact 7 and a socket contact may be used as the receptacle contact 15.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A lever connector comprising:

a plug including:

a plug contact including a plug contact portion;

a plug housing that holds the plug contact; and a lever that is rotatably attached to the plug housing; and a receptacle including:

a receptacle contact including a receptacle contact portion capable of coming into contact with the plug contact portion; and a receptacle housing that holds the receptacle contact, the plug and the receptacle being pulled together by rotation of the lever in a first rotation direction, wherein the lever has a lever driven surface that faces in a second rotation direction, the second rotation direction being opposite to the first rotation direction, the receptacle housing formed with a rack having a plurality of surfaces, one of the surfaces having a receptacle driving surface that faces in a separating direction, the separating direction being opposite to an approaching direction in which the plug is caused to approach the receptacle so as to mate the plug with the receptacle, in a first state where the plug confronts the receptacle so as to mate the plug with the receptacle, a first distance between the lever driven surface and the receptacle driving surface is smaller than a second distance between the plug contact portion and the receptacle contact portion, the first distance being equal to a distance of the movement of the plug toward the receptacle until the lever driven surface is brought into contact with the receptacle driving surface from the first state, the second distance being equal to a distance of the movement of the plug toward the receptacle until the plug contact portion is brought into contact with the receptacle contact portion from the first state, and when the plug is moved toward the receptacle, the lever driven surface is first brought into contact with the receptacle driving surface to cause the lever to rotate, in the first rotation direction, and after that, the plug contact portion is brought into contact with the receptacle contact portion.

2. The lever connector according to claim 1, wherein the plug includes a lever temporary holding mechanism that temporarily holds the lever in such a manner that the lever driven surface and the receptacle driving surface are opposed to each other in the approaching direction in a state where the plug confronts the receptacle so as to mate the plug with the receptacle, the lever temporary holding mechanism is formed of a temporary holding elastic piece that is supported by the plug housing in a cantilever manner, the temporary holding elastic piece hooks on to the lever, thereby inhibiting the rotation of the lever in the first rotation direction, when the plug is moved toward the receptacle, the temporary holding elastic piece is brought into contact with the receptacle and elastically deformed, and the elastic deformation releases the inhibited state.

3. The lever connector according to claim 1, wherein the lever has a lever driving surface that faces in the first rotation direction, the receptacle housing has a receptacle driven surface that faces in the approaching direction, and when the lever is rotated in the first rotation direction in a state where the plug contact portion is in contact with the receptacle contact portion, the lever driving surface is brought into contact with the receptacle driven surface.

* * * * *